US005775825A

United States Patent [19]

Hong et al.

[11] Patent Number: 5,775,825

[45] Date of Patent: Jul. 7, 1998

[54] INTEGRATED SHELL-AND-CHASIS CONSTRUCTION FOR A DESKTOP IMAGE-RELATED DEVICE

[75] Inventors: Juehui Hong; Olev Tammer, both of San Diego; Salomon X. Valencia, Laguna Hills, all of Calif.

[73] Assignee: Hewlett-Packard Company, Palo Alto, Calif.

[21] Appl. No.: 684,736

[22] Filed: Jul. 22, 1996

[51] Int. Cl.[6] ..... B41J 29/02

[52] U.S. Cl. ..... 400/693; 400/694; 347/108

[58] Field of Search ..... 400/693, 120.01, 400/692, 694, 690–690.4; 347/108, 109, 263

[56] References Cited

U.S. PATENT DOCUMENTS

| | | | |
|---|---|---|---|
| 4,619,944 | 10/1986 | Galatha et al. | 400/692 |
| 4,732,502 | 3/1988 | Yokoi | 400/693 |
| 5,447,380 | 9/1995 | Colonel et al. | 400/120.01 |

FOREIGN PATENT DOCUMENTS

| | | | |
|---|---|---|---|
| 0040284 | 3/1985 | Japan | 400/691 |
| 0209966 | 8/1988 | Japan | 400/691 |

*Primary Examiner*—Christopher A. Bennett

[57] ABSTRACT

The invention protects a printer, scanner, copier and/or FAX machine against shock, particularly during shipping and the like. The system includes side covers, and a subsystem to attach them to a major chassis element. Preferably this subsystem omnidirectionally transfers shock between the covers and the chassis element, and includes a hand-in-glove fit of a portion of the chassis element into each cover, with a snap connector holding the chassis element and covers in the hand-in-glove fit. Also preferably a subsystem is included to attach the covers to a main structural assembly. This subsystem is integrally formed in the covers and main assembly, and takes up at least four degrees of freedom of motion between them. Another preferable subsystem attaches the covers to a first major chassis element with omnidirectional transfer of shock loads, and to a second major chassis element with directionally selective coupling of such loads—particularly as between forces generally tangential to the covers and forces generally normal to the covers.

20 Claims, 15 Drawing Sheets

10'
18'
14
18
16
17
15
10
12
15'
11

25
25'
21
22
22'
26
27
28'

28
24
28'
28

20
24

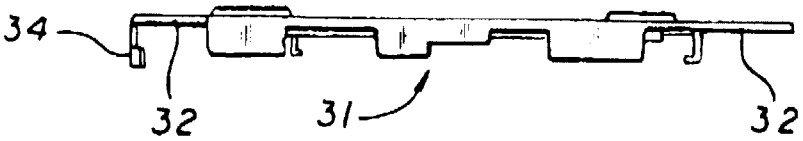
FIG. 20
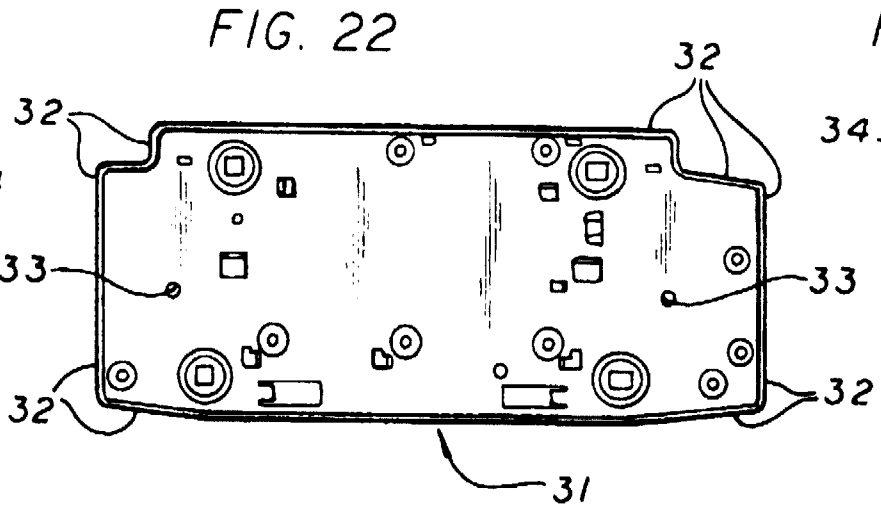
FIG. 22
FIG. 23
FIG. 21
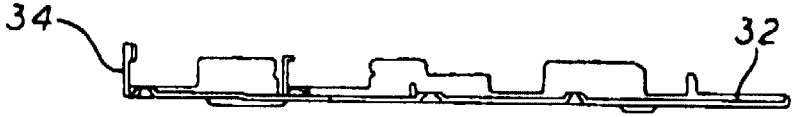
FIG. 24
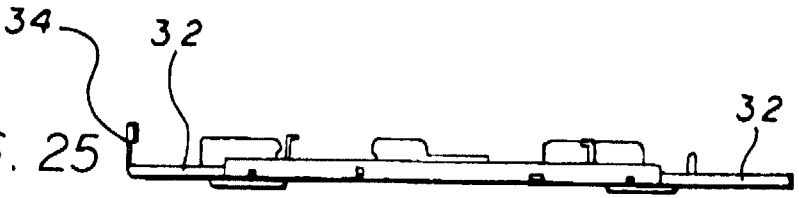
FIG. 25
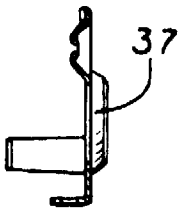
FIG. 26
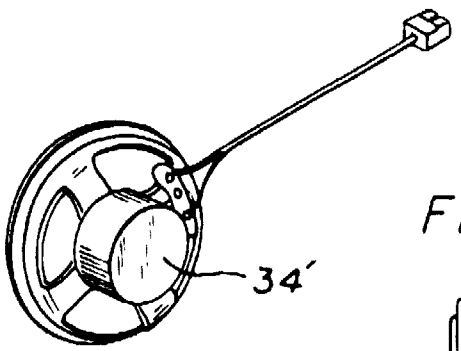
FIG. 27
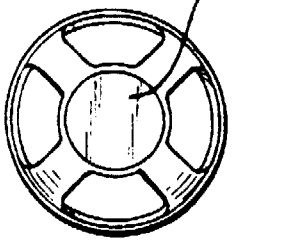
FIG. 28

62
63
66
66'
67
34
35
36

INTEGRATED SHELL-AND-CHASIS CONSTRUCTION FOR A DESKTOP IMAGE-RELATED DEVICE

FIELD OF THE INVENTION

This invention relates generally to desktop-size image-related devices for acquiring images from or printing text or graphics onto image media; and more particularly to constructional technologies for fashioning a case and chassis—or in other words an enclosure-and-structural system—for such a device.

By the phrase "image-related device" we mean to encompass a machine that is a scanner, or a printer, or both (i. e., a copier), or a facsimile transceiver, or can perform any combination of these functions.

By "image media", for purposes of this document, we mean to encompass for example paper, transparency stock, and glossy media. We further mean to encompass both image-bearing media (from which an image is to be acquired or "scanned") and printing media or image-receiving media (onto which an image is to be printed).

BACKGROUND OF THE INVENTION

Typically enclosures for modern desktop use in the office or home have been either:

nonstructural plastic skins over sheet-metal frames, as in usual manufacture of computers; or rigid shells enveloping the mechanism, as in usual manufacture of printers.

Both of these approaches produce structures that are expensive to make, due to relatively thick-walled parts that lead to subtle added costs for material, molding and storage. The first also produces structures that are heavy and so cost more to ship, and the second produces overall structures that are relatively large and so again cost more to store.

The second technique also has an even more severe drawback: the internal mechanisms in general are usually cantilevered within their shells. This construction invites mechanical deformation in event of shock loading, such as can occur during shipping—or even when the machine is moved within a home or office.

Dropping the machine a relatively short distance, or shoving the machine only moderately hard, creates relative acceleration between the chassis and the cantilevered mass. This relative acceleration can cause the mass to act on the cantilevering structure like a force operating through a lever—to exert much higher, damaging levels of force on the components in the region of attachment.

In other words, the deformation magnifies the shock load and so tends to aggravate damage. The relatively heaviness of the parts worsens this problem.

(It is possible that damage of this sort is particularly likely if shock loading from a particular direction is transfered, by the overall system of attachments between shells and mechanism, directly to the mechanism within the shells—generally following the same line of force as that of the external shock. Where the internal geometry of the apparatus happens to render it vulnerable to forces that are just so aligned, disproportionate damage results.)

With respect to the orientation of the shells, this problem is symmetrical. That is to say, it is the geometry of the internal apparatus, not the orientation of the shell faces, that tends to define this type of directional vulnerability.

In summary, many prior enclosures offer protection that is inadequate, possibly due to a combination of (1) internally cantilevering configurations with (2) susceptibility to direct, directional transfer of shock through the shells. Either alone is undesirable, and the combination of the two is worse.

It should be noticed, however, that avoiding both these undesirable characteristics at the same time can sometimes be awkward—because keeping ample distance between the internal parts and the shells may tend insidiously to lead designers toward cantilevered constructions. It also yields bulky configurations that are, still again, expensive to ship and store.

A second and different class of problems arises where a chassis is positioned closely adjacent within an exterior face (any face, including a side, rear or front wall) of a case. Such a chassis is particularly vulnerable to shock transfered directly by the attachment with the exterior face. Here we are talking about a single specific adjacent face itself and its attachment to the chassis, rather than the overall system of attachments mentioned earlier, as the route for transmission of shock.

Shock can be directly transfered if the apparatus is dropped onto the adjacent exterior face, or if that face receives any other strong impact. This class of problems should be differentiated from those described earlier, in that the potential for damage arises not so much from the internal geometry of the working parts themselves, or from the geometry of their attachment to the cases, but rather simply from the proximity of the exterior face and its direct attachment.

Adjacency to the exterior face creates an asymmetrical hazard of damage, from a particular direction, that can be expressed in simple terms of the orientation of that face, and proximity of apparatus within—without regard for structural axes of that apparatus. Prior configurations in desktop image-related devices fail to protect the chassis from damage in such incidents.

Still a third type of damage occurs in desktop devices whose shells are not strong enough to withstand impact, as for instance when efforts to mitigate expense and weight problems have led to use of walls that are too thin. Such shells can fail either by flexing or breaking—i. e., in either instance, giving way so that the impact passes directly through the shell to the apparatus within.

Both of the typical desktop-device enclosure methodologies (computer configurations and printer configurations) typically call for assembly procedures that involve mutual alignment of components that are essentially independent shapes. Almost the only common element, for example, as between a typical computer case and its chassis is the spacing of the mounting-screw holes.

Therefore the case must be carefully aligned to the chassis—and often distorted forcibly to obtain alignment—so that the mounting screws can be installed. Of course such procedures are time consuming and therefore expensive.

Some other industries use constructional techniques not previously associated with desktop image-related devices. For example in manufacture of airplanes it is known to integrate the outer shell of a vehicle with the many components that must fit within it, and with the chassis as well, so that the components actually contribute to the structural integrity of the shell and minimize the overall weight of purely structural elements needed.

In manufacture of automobiles it is known to use a so-called "unibody" construction in which formed sheet-metal underparts, firewall etc. are integrated with the chassis for extremely high resistance to twisting or crushing. These techniques have not heretofore been associated with desktop image-related devices.

Conclusion-Conventional approaches have continued to impede achievement of uniformly excellent mechanical integrity in lightweight, economical cases and chassis for desktop printing machines. Thus important aspects of the technology used in the field of the invention remain amenable to useful refinement.

SUMMARY OF THE DISCLOSURE

The present invention introduces such refinement. In its preferred embodiments, the present invention has several aspects or facets that can be used independently, although they are preferably employed together to optimize their benefits.

In preferred embodiments of each of these facets or aspects, the invention is an enclosure-and-structural system for a desktop image-related device that is subject to shock loads during shipping and the like. The phrase "image-related device" has been defined earlier for purposes of this document. The system according to each of the aspects or facets includes plural side covers.

In preferred embodiments of a first of its aspects or facets, the system also includes a major chassis element of the image-related device. The system further includes some means for attaching the covers to the chassis element. For purpose of generality and breadth in discussion of the invention, we shall refer to these means as the "attaching means".

The attaching means in turn include some means for omnidirectional transfer of such shock loads between the covers and the chassis element. Again for breadth and generality we will call these means the "transfer means".

(As will be seen, the invention includes various shock-transfer means. At each point in the discussion and appended claims, however, it will be clear which of the transfer means are under consideration.)

The transfer means include a hand-in-glove fit of a portion of the chassis element into each of the covers.

The foregoing may constitute a description or definition of the first facet of the invention in its broadest or most general form. Even in this general form, however, it can be seen that this aspect of the invention significantly mitigates the difficulties left unresolved in the art.

In particular the hand-in-glove fit tends to ensure that shock is solidly transfered to the major chassis element and thereby to the internal mechanism as a whole. In this way, associated accelerations are applied rather uniformly to the entire mass of the mechanism, leading to minimal relative forces between components.

In general this arrangement avoids localization or focus of forces in some smaller portion—which otherwise may suffer disproportionate damage. Depending on the character of the force, this system also sometimes leads to relatively small force on each submass.

Although this aspect of the invention in its broad form thus represents a significant advance in the art, it is preferably practiced in conjunction with certain other features or characteristics that further enhance enjoyment of overall benefits.

For example, it is preferred that the transfer means further include, for each cover, complementary retaining means formed integrally in that cover and in the chassis element respectively. These complementary retaining means mutually engage to hold that cover and the base together in the hand-in-glove fit.

Also preferably the major chassis element is a formed sheet-metal base, which has plural edges. In this instance preferably the hand-in-glove fit of the transfer means comprises, in each cover, a slot for receiving a respective edge of the base.

It is also preferable that main structural assemblies be secured to both the base and the covers, and in particular secured at or near opposed extremes (sides, faces or corners etc.). These practices minimize cantilevering and its associated problems discussed earlier.

If the image-related device includes a component such as a speaker, it is moreover preferred that the transfer means further include some means for securing the component to one of the covers—and also some means for securing the speaker to the base too, for transmission of shock loads between the base and that one of the covers, through the component.

Preferably the covers are each integrally molded as a complex shape in thin plastic with large surfaces forming compound curves. This arrangement is important for fabrication economy and low shipping weight, and lends itself to distinctive styling.

In addition some complex shapes, particularly with compound surfaces, may be better able than regular parallelepiped shapes to accept severe impact without failure by either breakage or gross flexure. Also, possibly, complex shapes may tend to react to shock by deforming in multiple modes, to some extent redirecting directionally received shock into all six degrees of freedom.

To the extent that this may actually occur, the complex shape thereby tends to lower the portion of the received shock that remains oriented along any particular initial axis—to only some fraction of the incident shock. In this way the directionality of incoming shock may possibly be attenuated. The overall utility of our invention, however, has been validated through testing and in no way depends upon the validity of this particular theory as to possible shock attenuation.

Such a benefit, to the extent present, is enhanced through interaction of the complex molded shapes with the omnidirectional transfer means, which tend to maintain that same distribution in passing the shock on to the chassis. This symmetrical or isotropic distribution of mechanical shock received in the outside covers, to a major chassis element, allocates fractions of the incoming shock distributively to all of the components and their masses within the covers.

Other preferences will appear from following portions of this document.

In the system of a second aspect of the invention, in its preferred embodiments, the system includes—in addition to the covers—a main structural assembly. It also includes some means for attaching the covers to the main structural assembly.

These "attaching means" are integrally formed in the covers and the main structural assembly. These means include coupling means which take up at least four degrees of freedom of motion between the covers and the main structural assembly.

The foregoing may constitute a description or definition of the second facet of the invention in its broadest or most general form. Even in this general form, however, it can be seen that this aspect of the invention too significantly mitigate the difficulties left unresolved in the art.

In particular, the integrally formed coupling means provide an especially economical way of achieving solid omnidirectional—or nearly omnidirectional—coupling for transfer of shock loads solidly between covers and chassis. Despite this economy, the results are generally as discussed above for the first aspect of the invention.

Although this second aspect of the invention in its broad form thus represents a significant advance in the art, it is preferably practiced in conjunction with certain other features or characteristics that further enhance enjoyment of overall benefits.

For instance, we strongly prefer that the coupling means include no separate fastener. Preferably the system does includes further (separate) coupling means which take up substantially all remaining motional freedom between the covers and the main structural assembly.

Thus as an example the particular configuration which we consider best has a first coupling means that take up what may be called "five and a half degrees" of freedom. More specifically, in that configuration some freedom to rotate remains, but it is very slight. The "further coupling means", by stabilizing the attachment against this slight rotation, take up the remaining "half degree".

Preferably the main structural assembly includes a formed sheet-metal base and a chassis rigidly mounted to the base. We also prefer that the first-mentioned coupling means hold the sheet-metal base to the covers, and that the further coupling means hold the chassis to the covers.

In a third basic aspect or facet, the system includes a first major chassis element, and first means for attaching the covers to the first chassis element. The first attaching means include means for omnidirectional transfer of shock loads between the covers and the first chassis element.

Additionally included is a second major chassis element, disposed within the image-related device and closely adjacent to an interior surface of at least one cover. This system also includes second means for attaching the at least one cover to the second chassis element.

The second attaching means include means for directionally selective coupling of shock loads between the second chassis element and the at least one cover. Such coupling might also be termed "differential" coupling.

By "selective coupling" or "differential coupling" we mean that the loading transfer and distribution are particularly arranged to be of significantly different magnitudes in different directions. In regard to this third main facet or aspect of the invention, we employ differential load distribution to resolve asymmetrical functional problems.

Here the term "asymmetrical" is meant with respect to the faces of the covers, rather than with respect to the internal apparatus. Such asymmetrical problems, described earlier in the "BACKGROUND" section of this document, particularly include transfer of impacts to the internal chassis merely because of its proximity to the covers.

In particular these selective coupling means include, for each cover, some means for:

- transfering, between the additional chassis element and that cover, shock loads that are directed generally tangential to the local surface of that cover, but
- taking up shock loads that are generally normal to the local surface of that cover.

The selective coupling means operate to minimize normal shock-load transfer between the chassis and that cover.

This may constitute a description or definition of the third main facet or aspect of the invention in its broadest or most general form. Even as thus generally or broadly couched, however, it will now be clear that this facet of the invention contributes in an important and different way to the previously suggested general objectives of the invention.

In particular this aspect of the invention represents one way of shock-protecting internal assemblies that are spaced closely to the inside surface of a cover. For example, in our preferred system a starwheel assembly is frontally exposed just inside the face of the image-related device.

The starwheel assembly accepts and engages image media after printing or scanning by the image-related device, and propels the image media into an output paper tray at the front of the device. Accordingly the starwheel chassis is advantageously close to the front exterior of the device, but therefore vulnerable to frontal shock—as, for instance, when the entire image-related device is dropped on its face.

If this occurs during shipping, and the device is in a shipping box with common Styrofoam® shock absorber, our invention ensures that the starwheel assembly—as well as the rest of the device—is substantially unaffected by the fall. We have verified this for drops of some 107 centimeters (forty-two inches).

In these tests for frontal falls (and for falls in many other orientations as well), we developed accelerations of over fifty times the acceleration of gravity (50 g), as compared with roughly thirty for prior enclosure-and-structural systems. Our operational tests after all such drops confirmed that a current prototype of the device—in addition to sustaining no visible damage—continued to meet all of its performance specifications.

Once again to optimize enjoyment of the benefits of this aspect of the invention, however, we prefer to practice this aspect of the invention with certain additional features or characteristics. Thus preferably the selective coupling means include, for each cover, means for:

- transfering, between the additional chassis element and that cover, shock loads that are generally tangential to the local surface of that cover, but
- taking up, with minimal shock-load transfer between the chassis and that cover, shock loads that are generally normal to the local surface of that cover.

Also the differential transfer and distribution means preferably include a one-degree-of-freedom slip fit.

In preferred embodiments of a fourth of its aspects, the system is for an image-related device. It includes a chassis (for example a media chassis) which has relatively little rigidity with respect to tilting or rotation in a particular direction.

The chassis is secured, however, to the covers. Accordingly it is subject to damage by transverse impacts causing major flexure of either side cover, in the same particular direction. The system also includes means for protecting the chassis by limiting flexure in that cover.

Preferably these protecting means include a flexure stop. By that we mean a boss, within the cover at each side, which stabilizes the cover against flexure in the particular direction.

We prefer that the boss perform this task by engaging, in the same particular direction, some structural element which is relatively more rigid in that direction. Preferably such a structural element is, for example, yet another chassis (e. g. a printer chassis).

All of the foregoing operational principles and advantages of the present invention—and other principles and advantages as well—will be more fully appreciated upon consideration of the following detailed description, with reference to the appended drawings, of which:

BRIEF DESCRIPTION OF THE DRAWINGS

FIG. 2 is a top plan;

FIG. 3 is a front elevation;

FIGS. 4 and FIG. 4' are right (i. e. interior) side elevations, identical except for scale as explained above;

FIG. 5 is a rear elevation;

FIG. 6 is a left side elevation;

FIGS. 7 and 7', identical but for scale, are isometric views taken from below and to the right rear of the cover;

FIGS. 8 and 8' are isometric views taken from above and to the right front;

FIG. 9 is a like view taken from above and to left rear;

FIGS. 10 through 19 (and 17') are like drawings of the right side cover of the same embodiment:

FIG. 11 is a top plan;

FIG. 12 is a rear elevation;

FIG. 13 is a left side (interior) elevation;

FIG. 14 is a front elevation;

FIG. 15 is a right side elevation;

Figures 11, 12, 13, 14, 15, 16, 17, 18, 19:
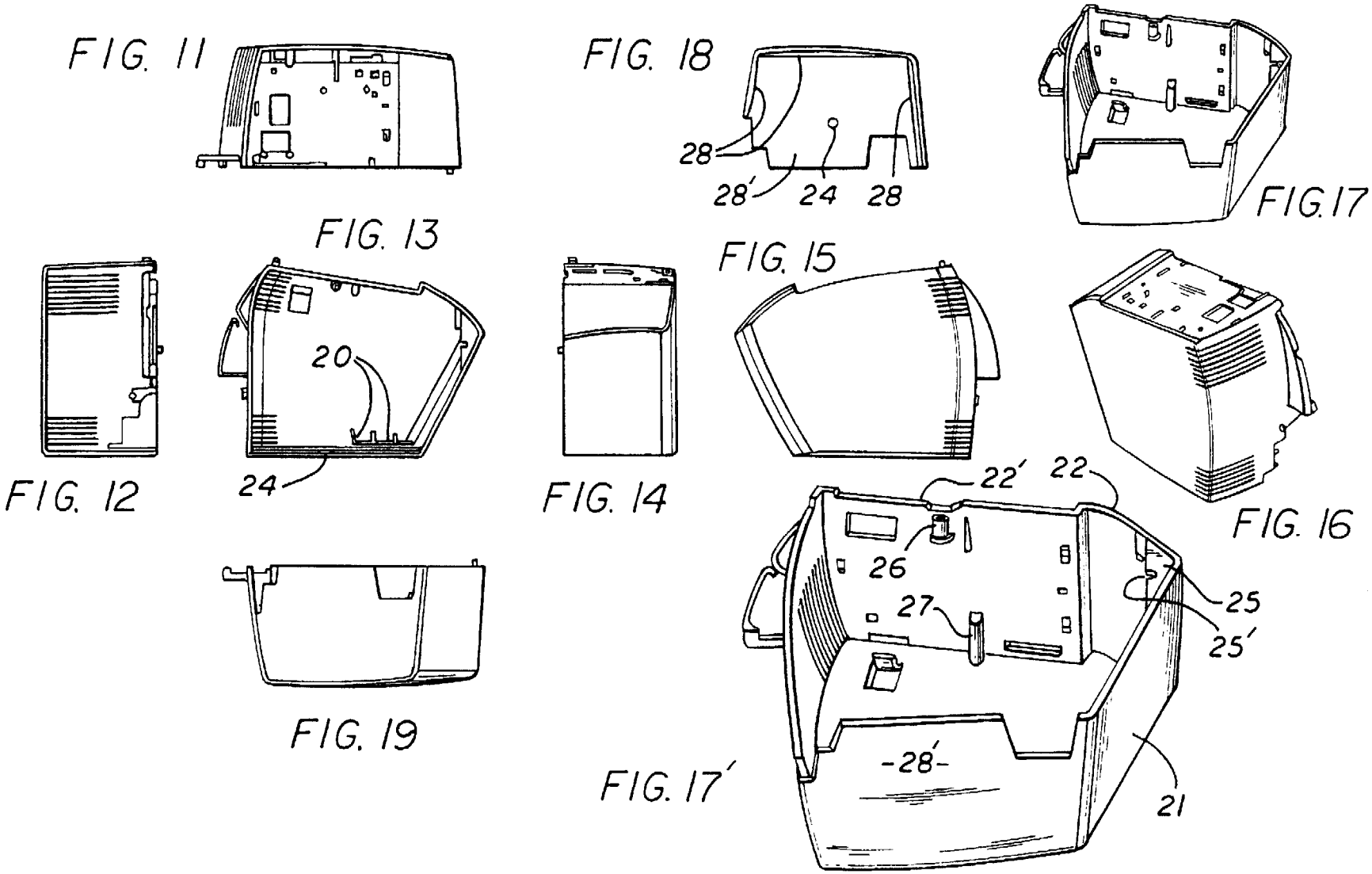
Figure 29:
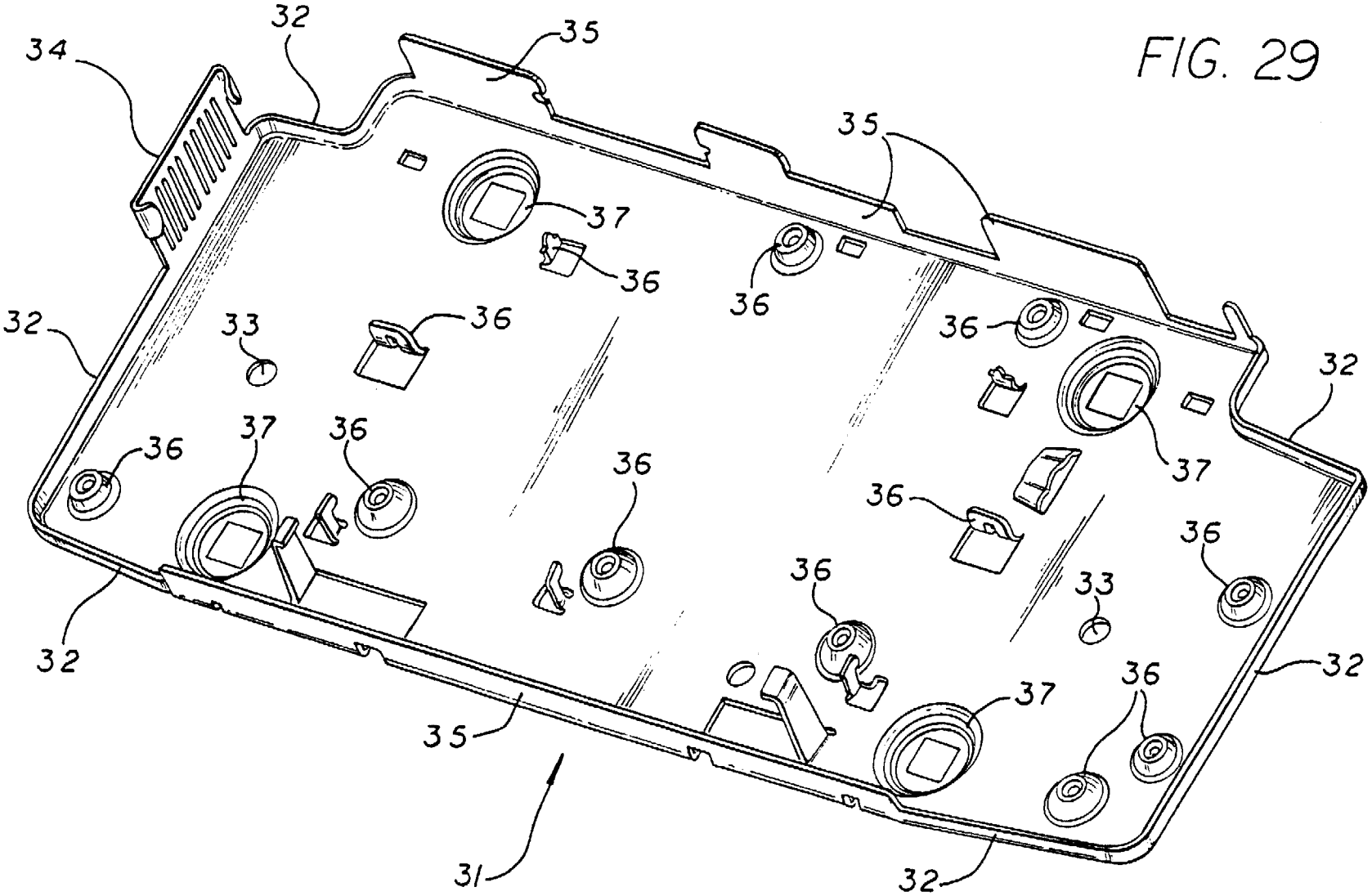
Figures 30, 31, 32, 33, 34, 35, 36:
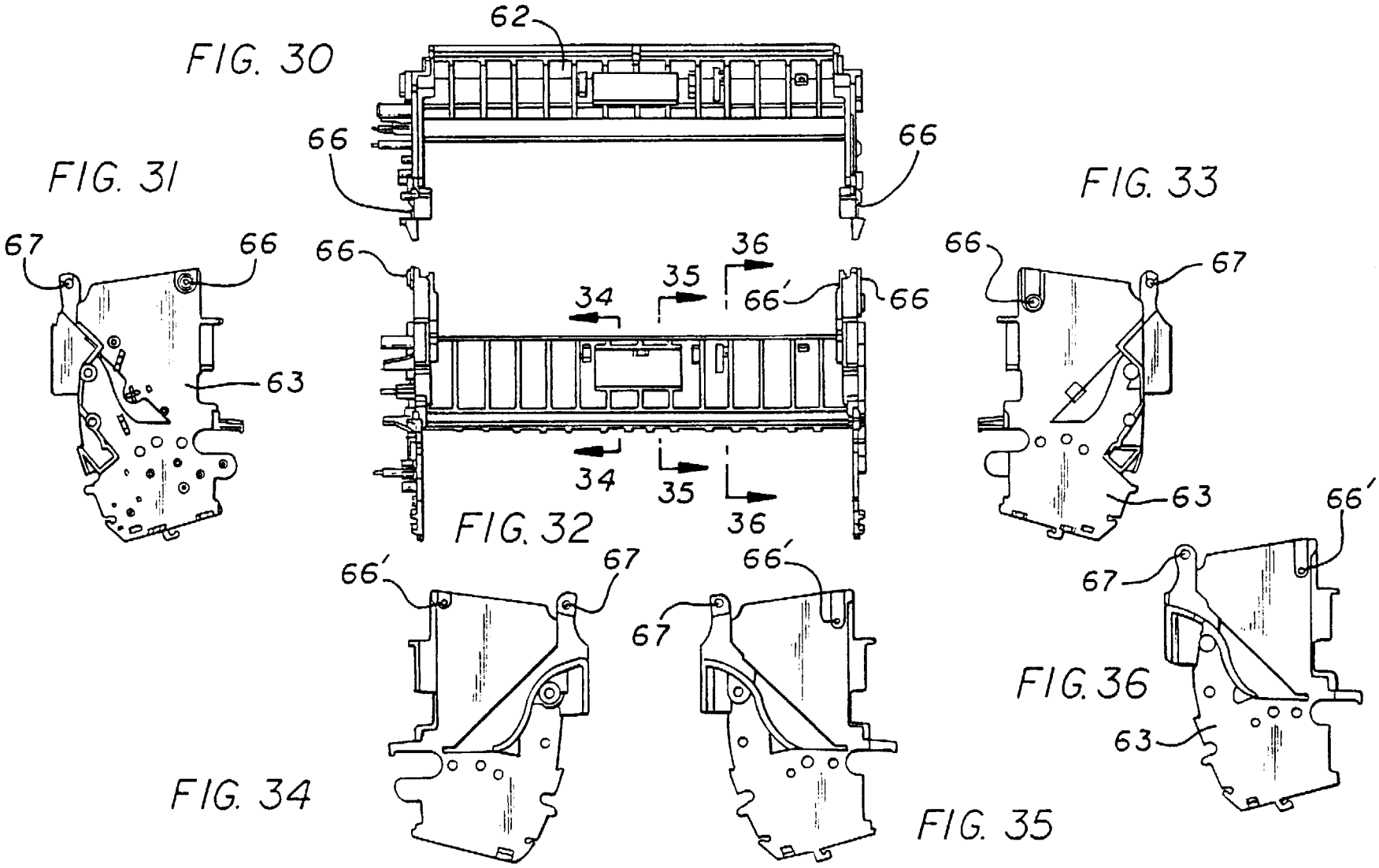
Figure 39:
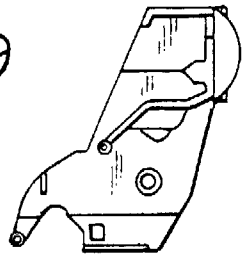
Figure 41:
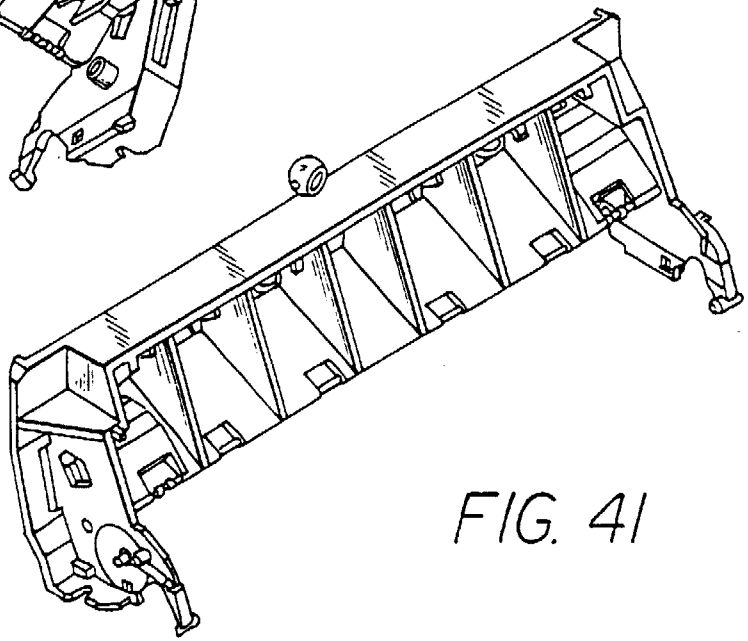
Figure 38:
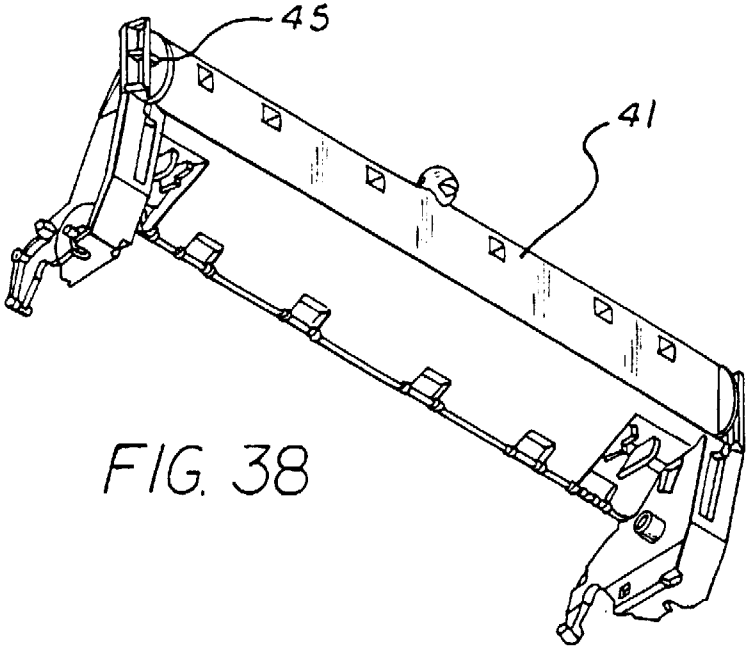
Figure 37:
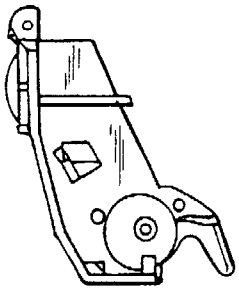
Figure 40:
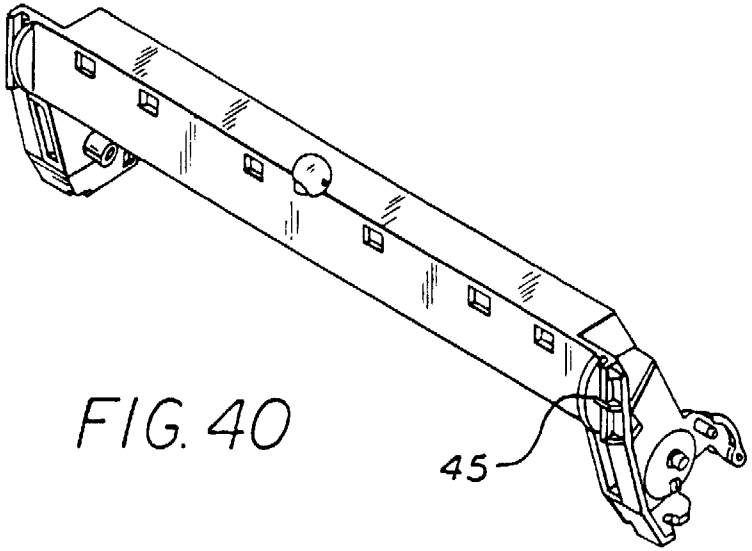
Figures 42, 43, 44, 45, 46, 47:
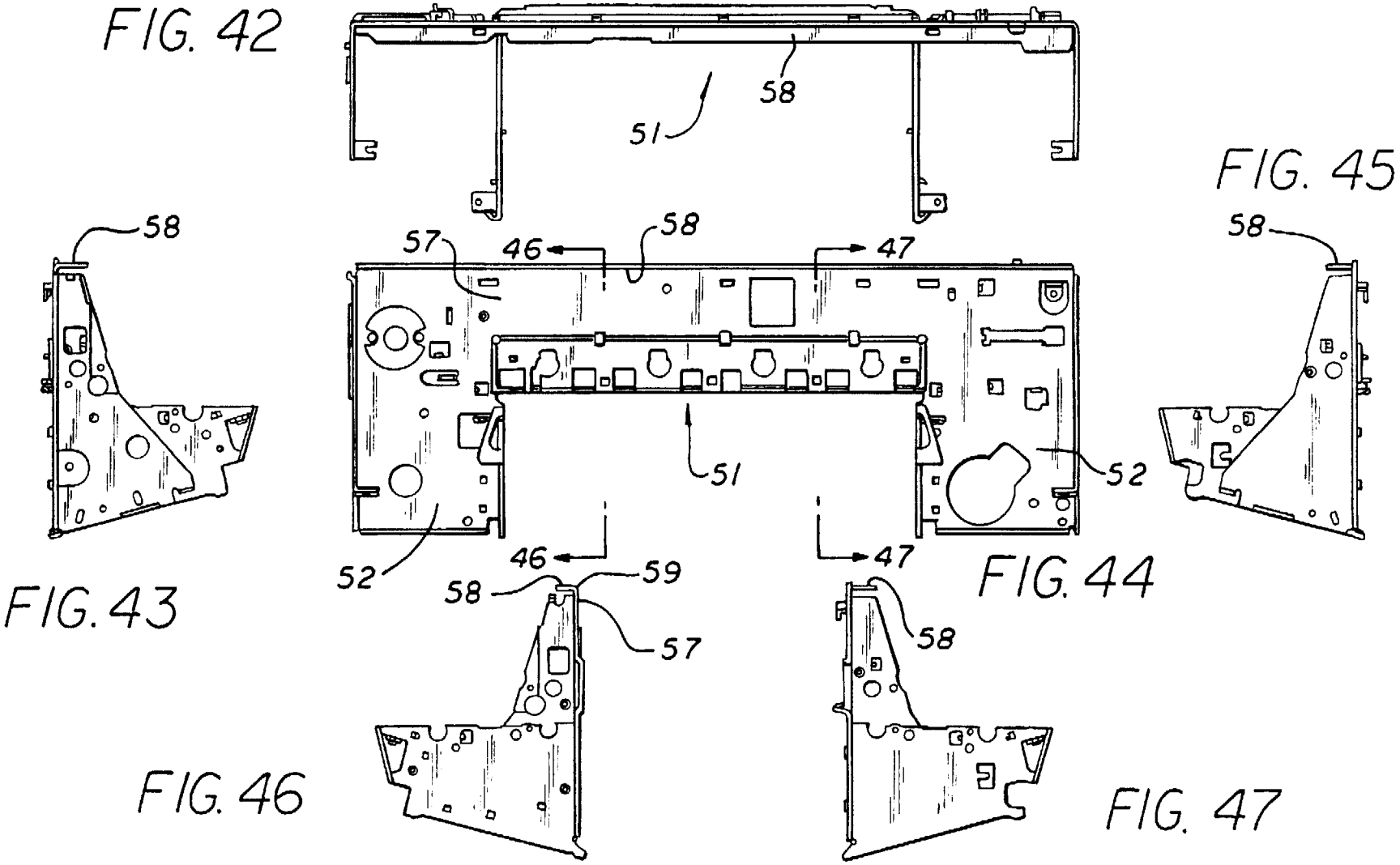
Figure 48:
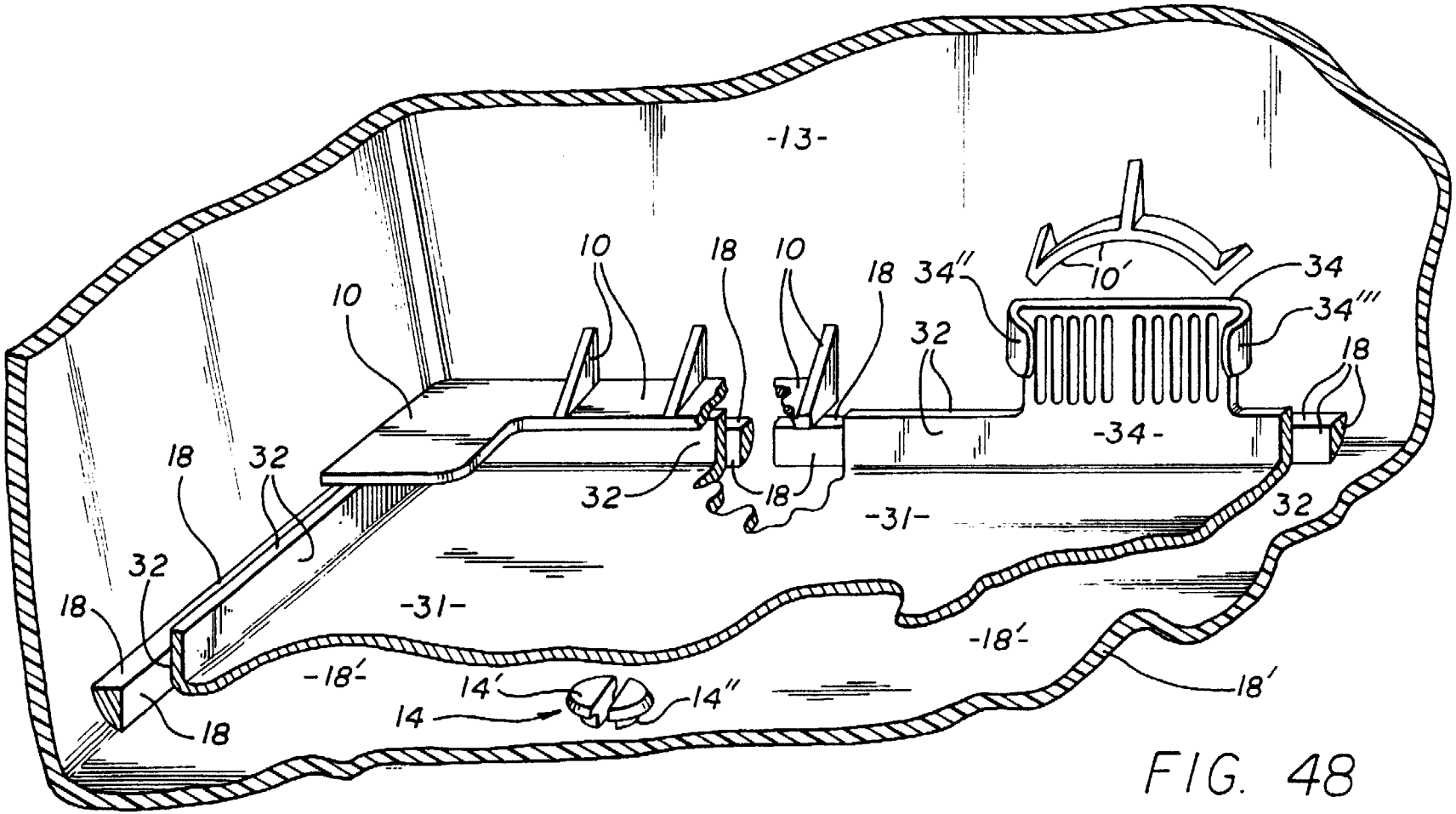
Figure 48A:
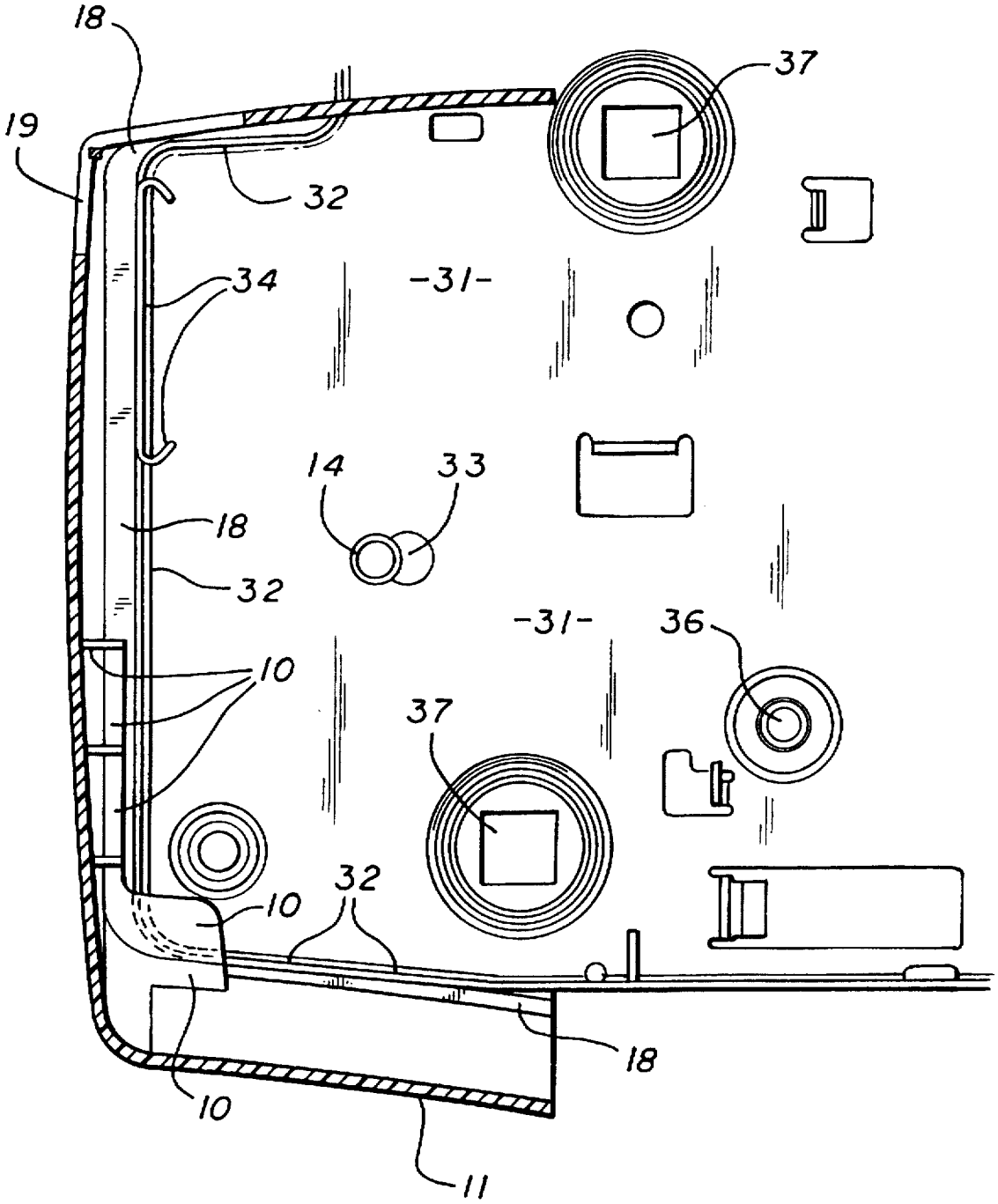
Figure 49A:
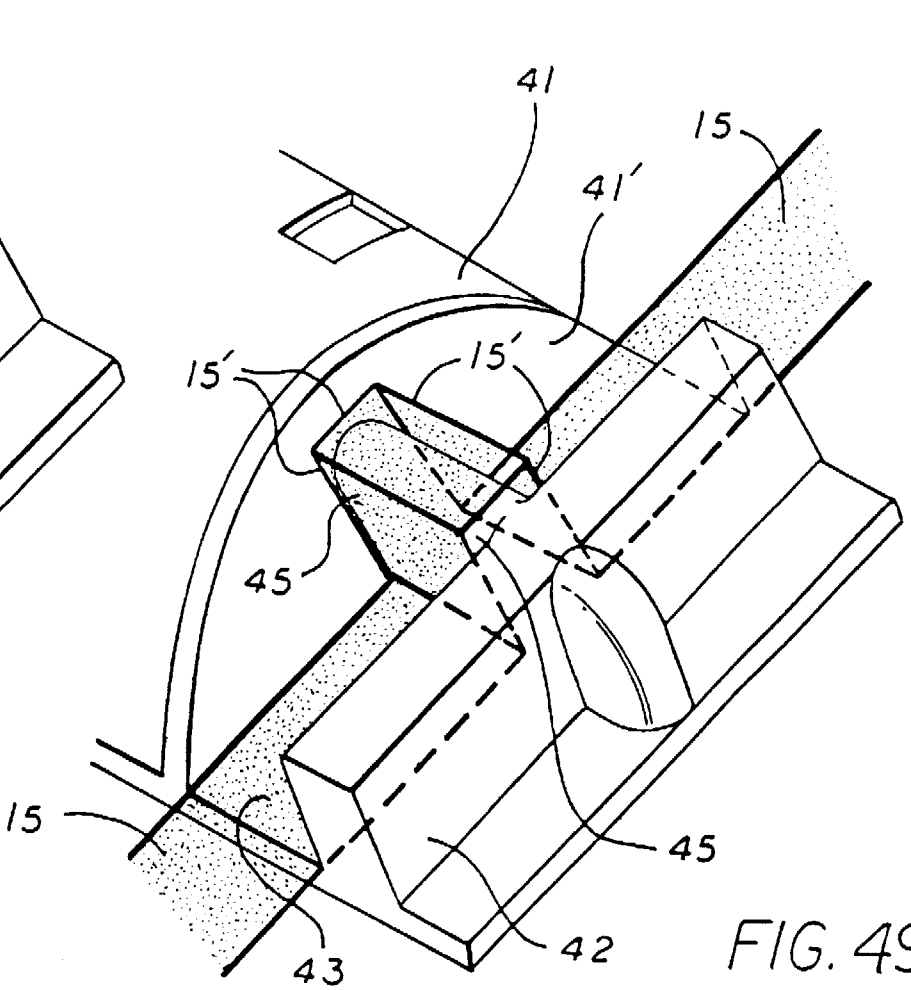
Figure 49:
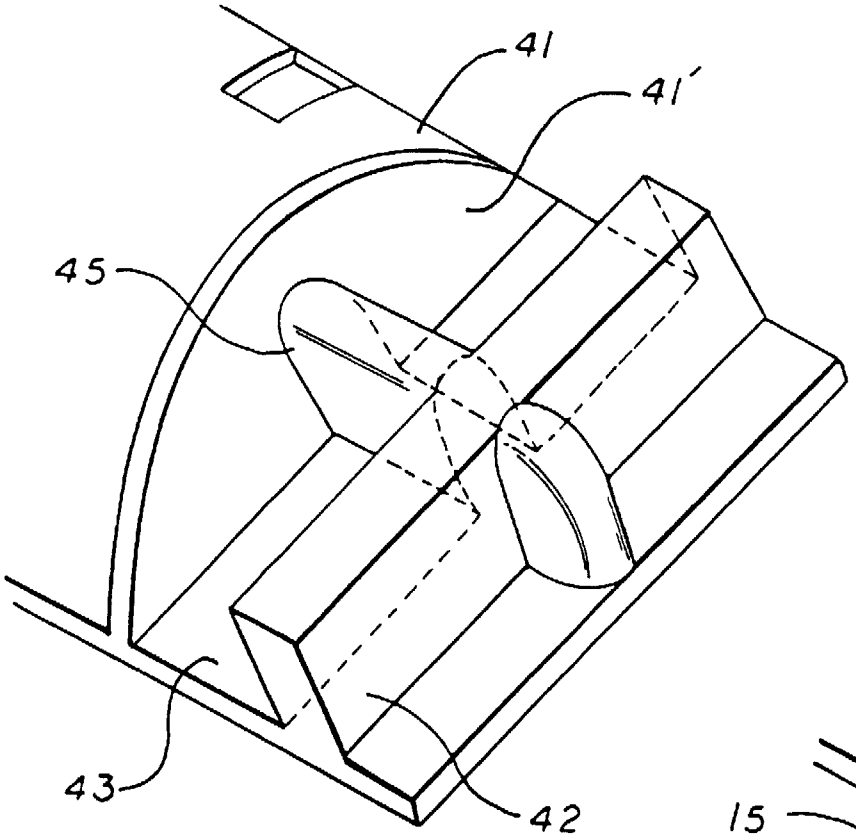
Figure 49B:
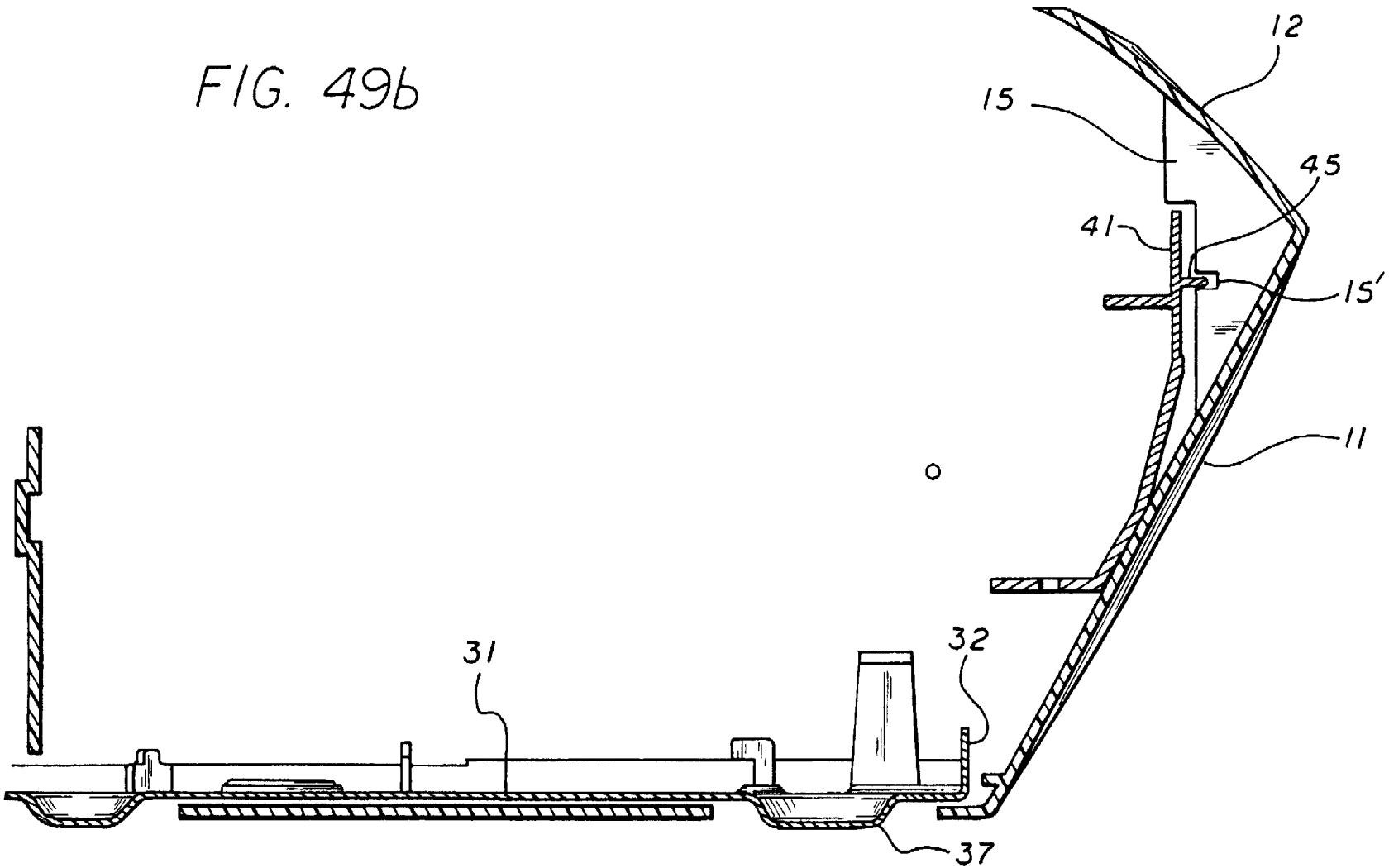
Figure 50A:
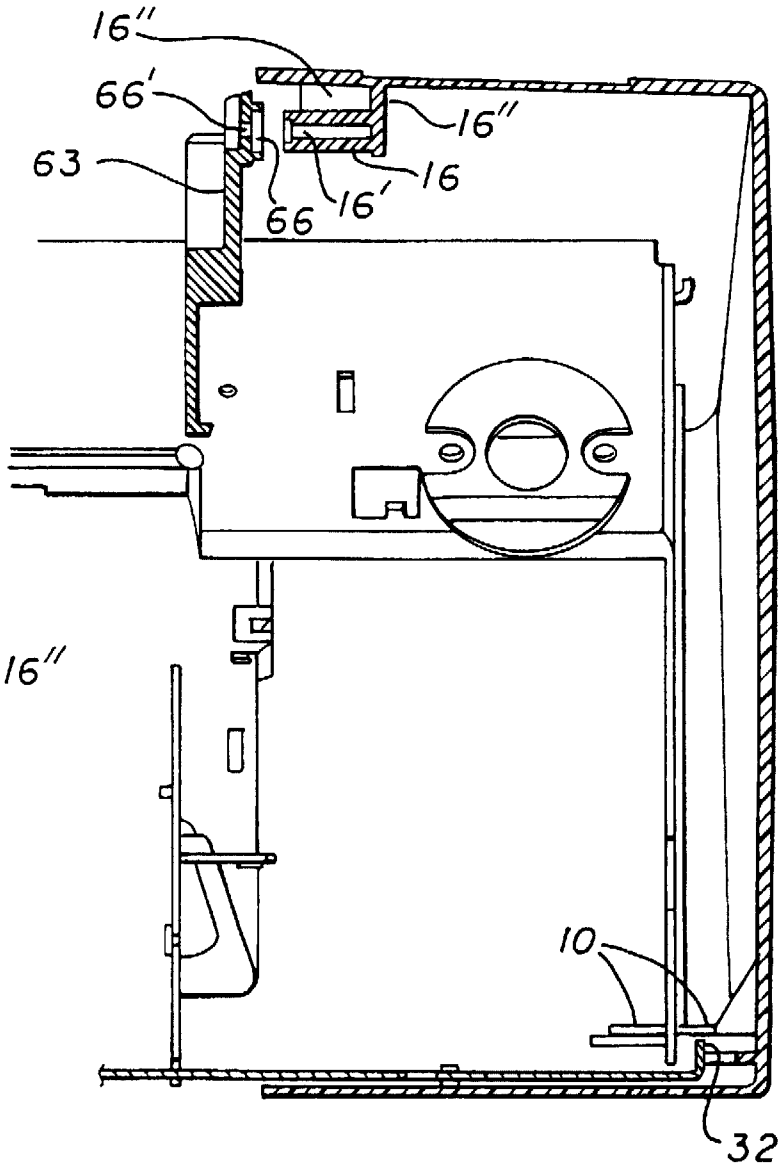
Figure 50:
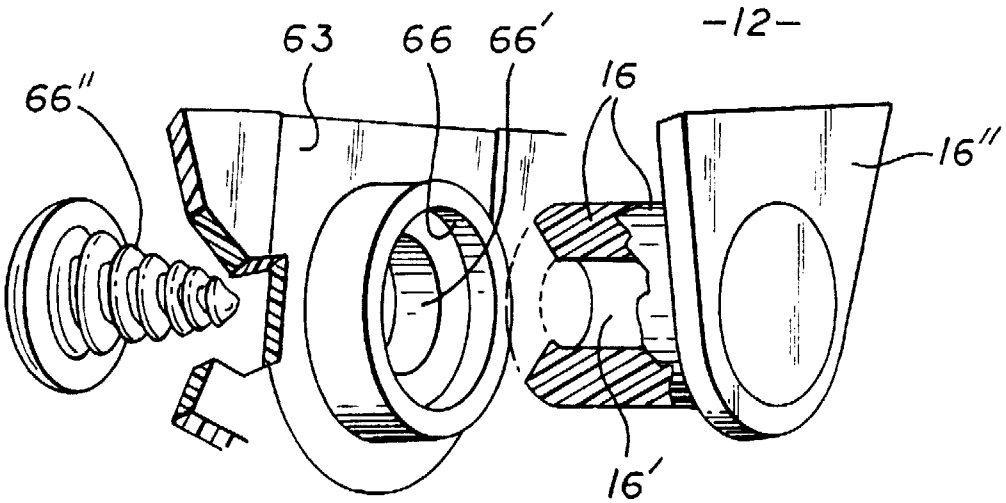
Figure 51:
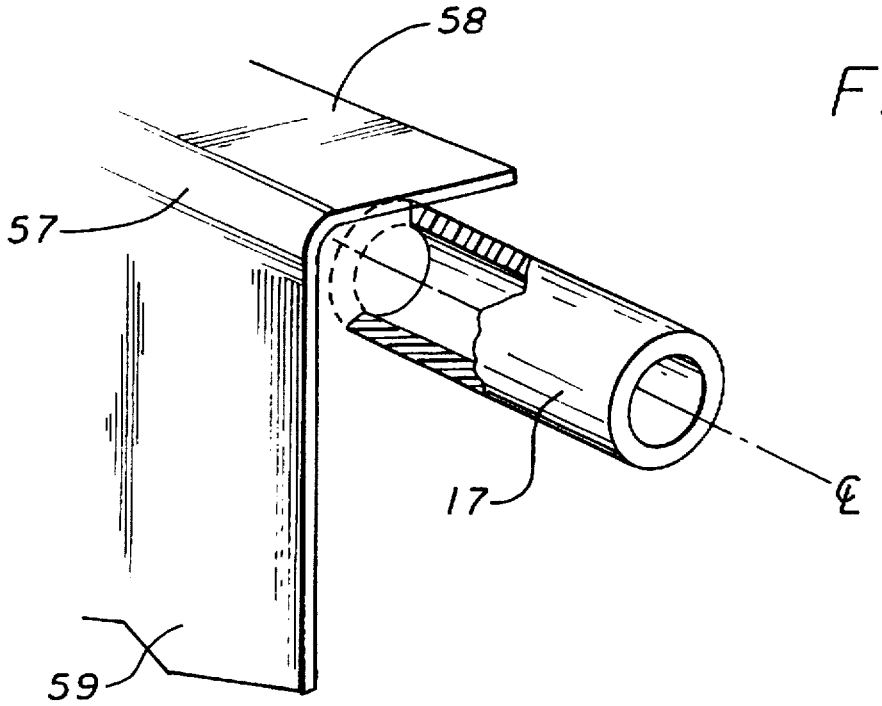
Figure 51A:
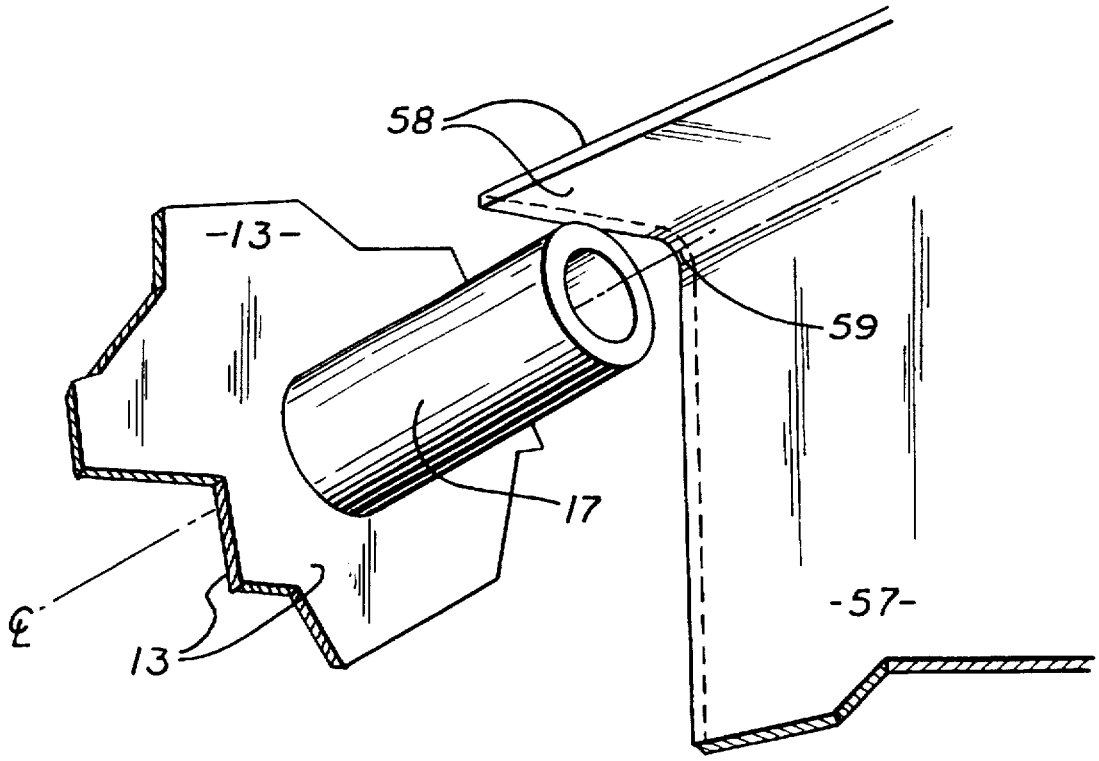
Figure 51B:
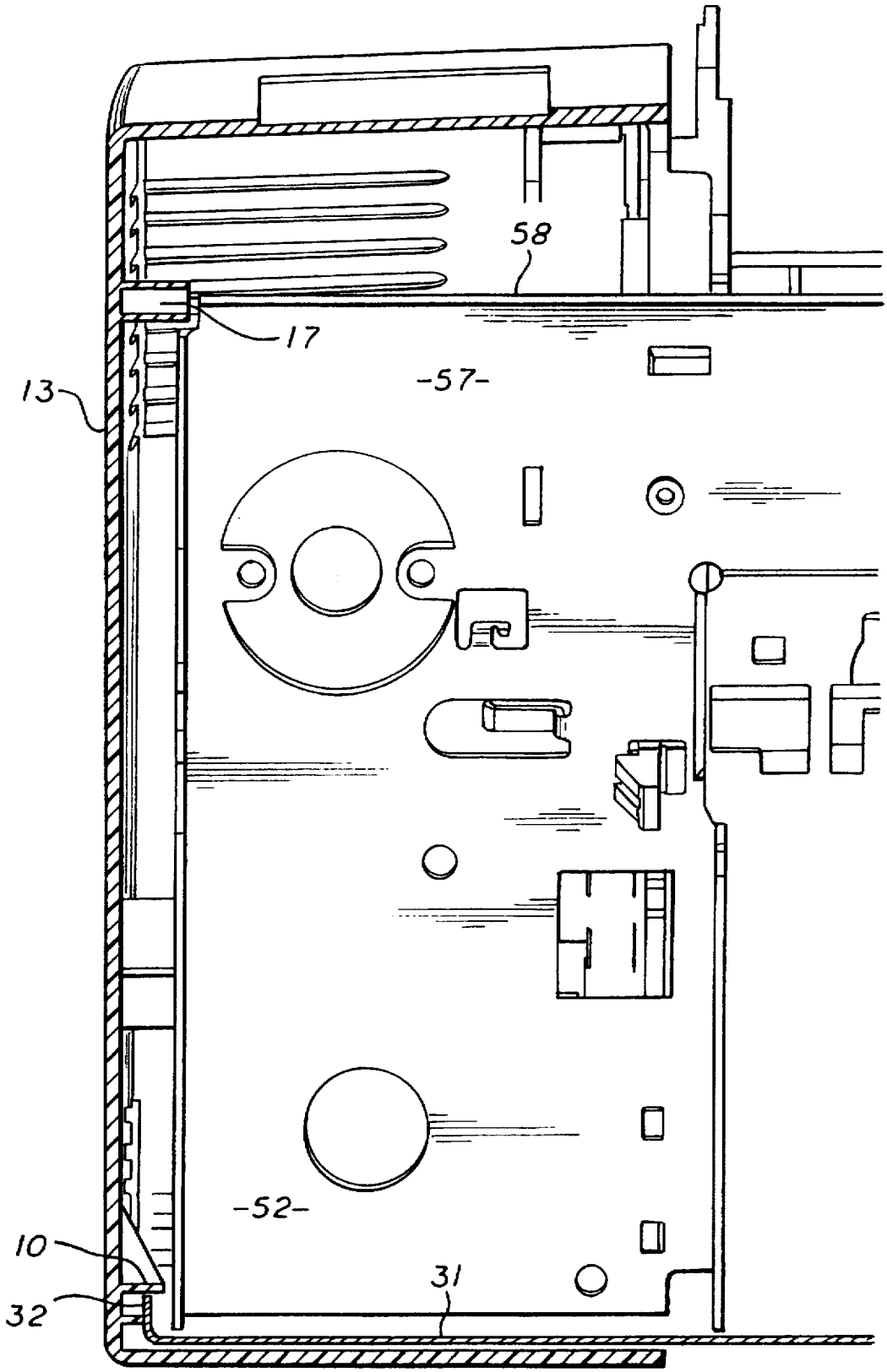

16 is an isometric view taken from the right rear;

FIG. 17 and FIG. 17' are isometric views taken from below and to the left of the cover;

FIG. 18 is a top plan of only the floor of the cover;

FIG. 19 is a bottom plan;

FIGS. 20 through 29 are drawings of the base (and one associated component, the speaker) of the same embodiment, as seen from various positions:

FIG. 20 is a rear elevation of the base, but drawn inverted for clearer indication of alignments with the adjacent plan;

FIG. 21 is a left side elevation of the base, but shown rotated clockwise ninety degrees for clearer indication of alignments with the plan;

FIG. 22 is a top plan of the base;

FIG. 23 is a right side elevation thereof but rotated counterclockwise ninety degrees for clearer showing of alignments;

FIG. 24 is a front elevation in section, taken through a dogleg path (relative to the FIG. 22 plan) passing through various key features of the base—to show these features generally but without identifying details that are not central to the present invention;

FIG. 25 is a front elevation;

FIG. 26 is a detail drawing of the bottommost (as drawn) part of the FIG. 23 elevation, but greatly enlarged;

FIG. 27 is an isometric view, taken from above and to the right front, of an electroacoustic speaker component that is mounted to the base and also secured to the media chassis;

FIG. 28 is a right side elevation of the FIG. 27 speaker;

FIG. 29 is an isometric view, taken from above and to the right front, of the base;

FIGS. 30 through 36 are drawings of a media chassis for the same embodiment, as seen from various positions:

FIG. 30 is a top plan, but with "top" defined as a view looking downward not vertically but parallel to an almost-vertical axis of the chassis;

FIG. 31 is a left side elevation, rotated so that the same axis of reference used in FIG. 30 is vertical;

FIG. 32 is a front elevation, again with "front" defined as looking rearward not horizontally but perpendicular to that same axis of reference;

FIG. 33 is a right side elevation, rotated as described for FIG. 31;

FIG. 34 is a sectional elevation, taken looking toward the left along the line 34—34 in FIG. 32;

FIG. 35 is a like view but taken looking toward the right along the line 35—35 in FIG. 32;

FIG. 36 is a like view but along the line 36—36 in FIG. 32;

FIGS. 37 through 41 are drawings of the starwheel chassis for the same embodiment:

FIG. 37 is a left side elevation;

FIG. 38 is an isometric view taken from below and to the left front of the chassis;

FIG. 39 is a right side elevation;

FIG. 40 is a view like FIG. 38 but from above and to right front;

FIG. 41 is a like view but from above and to right rear;

FIGS. 42 through 47 are drawings, like FIGS. 30 through 34, and 36, but of a printer chassis for the same embodiment:

FIG. 42 is a plan like FIG. 30;

FIG. 43 is a left elevation like FIG. 31;

FIG. 44 is a front elevation like FIG. 32;

FIG. 45 is a right elevation like FIG. 33;

FIG. 46 is a sectional elevation like FIG. 34 but along the line 46—46 in FIG. 44;

FIG. 47 is a sectional elevation like FIG. 35 but along the line 47—47 in FIG. 44;

FIGS. 48 and 48*a* are detailed views, enlarged, of the hand-in-glove fit of the FIG. 29 base into the side covers of FIGS. 2 through 19:

FIG. 48 for orientation is an isometric or perspective view of the left interior of the left-side cover with mating base, all taken from above right rear, drawn partially broken away, and highly schematic;

FIG. 48*a* is a top plan of the left end of the left-side cover and mating base, in transverse or left-to-right section (or "longitudinal" section with respect to the long dimension of the base);

FIGS. 49 through 49*b* are like views of the one-degree-of-freedom slip fit of the FIGS. 37–41 starwheel chassis to the same side covers:

FIG. 49 for orientation is a very greatly enlarged isometric or perspective view of the right end face of the upper portion of the starwheel chassis, taken from right front and slightly below, with some dashed lines to show hidden corners, and highly schematic;

FIG. 49*a* is a like view of the same end face but with those dashed lines removed and with a shaded overlay of a mating notch or slot in the cover—drawn in bold lines, dashed where hidden;

FIG. 49*b* is a left elevation of the left cover and portions of the mating starwheel chassis (and base), in fore-to-aft cross-section taken through the left end of the starwheel chassis;

FIGS. 50 and 50*a* are like views of the male-female feature connecting the FIGS. 30–36 media chassis to the same side covers:

FIG. 50 for orientation is a greatly enlarged isometric or perspective view of a cylindrical boss depending from the interior of the left side cover near the top inboard edge of that cover, together with a mating cylindrical receptacle in the top right front corner of the media chassis—all taken from left rear and very slightly below, and also highly schematic;

FIG. 50*a* is a rear elevation of the left cover and mating portions of the media chassis (above, and of the printer chassis and base below), in transverse cross-section;

FIGS. 51 through 51*b* are like views of a flexure-limiting stop which protects the media chassis from impact-generated flexure in the left side cover:

FIG. 51 for orientation is a greatly enlarged isometric or perspective view of the upper left corner of the printer chassis, together with the mating stop—all taken from upper left rear, and from just inside the outboard wall of the left side cover, and drawn partly broken away, and highly schematic;

FIG. 51*a* is a like view but taken from an exactly opposing viewpoint, i. e. from lower right front, and looking toward that same outer left wall, and drawn partly broken away and with some dashed lines to show hidden corners; and FIG. 51*b* is a front elevation in transverse section, taken in a plane just forward of the (inclined) printer chassis but through the center of the stop.

DETAILED DESCRIPTION OF THE PREFERRED EMBODIMENTS

Figure 1:
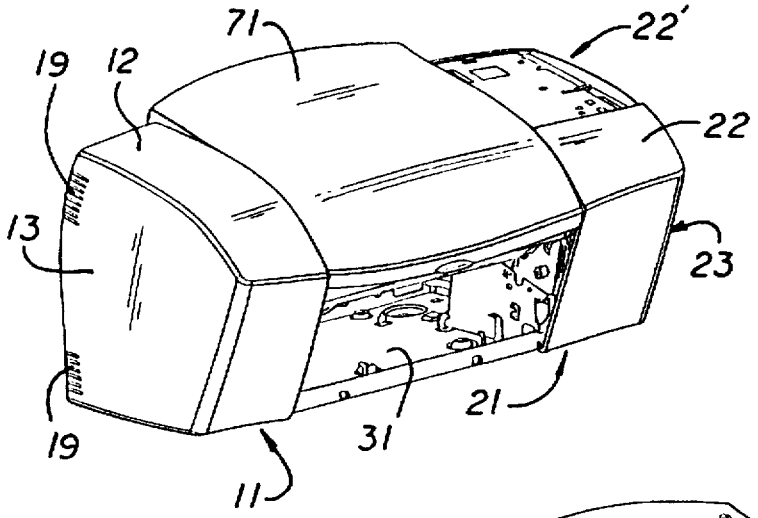
FIG. 1 is an isometric view, taken from above and to the left, of the exterior of a preferred embodiment of the invention (without control panel or paper trays in place)
Figure 1A:
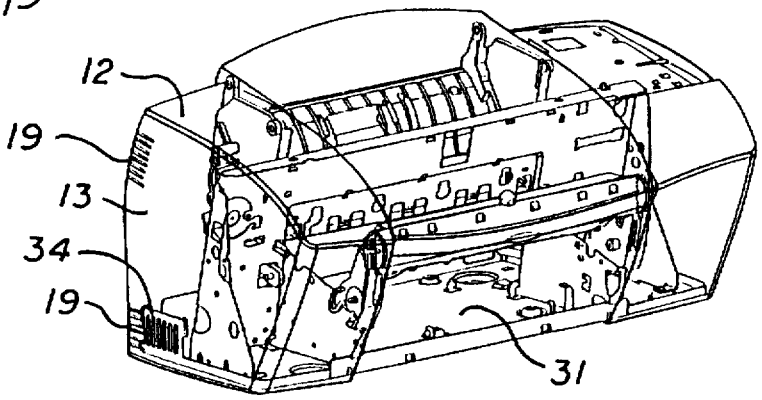
FIG. 1*a* is a like view of the same embodiment but with the side covers and top dust cover treated as if transparent, to show the covers in their relationships to all the main internal chassis elements within.
Figure 1B:
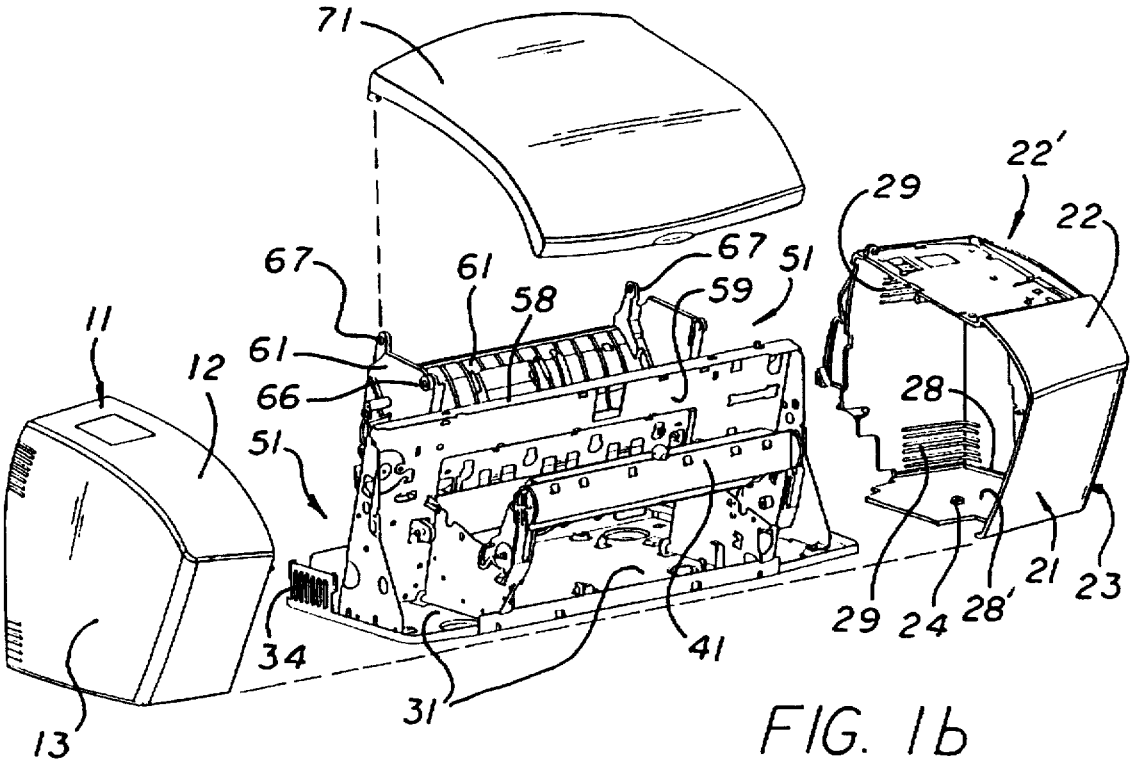
FIG. 1*b* is a like view of the same embodiment but exploded to show the internal chassis elements separately from the covers.

As shown in FIGS. 1 through 1*b*, preferred embodiments of the enclosure-and-structural system of the invention include opposed left and right side covers 11 and 21 of thin molded plastic—which are mated with an intermediately disposed formed base 31 of formed sheet metal. In purest principle, covers 11, 21 could be disposed at other positions with respect to the base 31, or a greater number of covers could be provided in various regions about the base.

Therefore the phrase "side cover" as used in this document, including the appended claims, is to be broadly understood as encompassing a cover at front or rear as well as, or instead of, left or right. Such equivalents are within the scope of certain of the appended claims.

Three main metal chassis 41, 51, 61 are rigidly mounted on the base 31 and are fastened strongly to both covers 11, 21. A dust cover 71, which does not contribute significantly to the structural relations of the system, is rotatably secured to hinges 67 at the upper rear of the rearmost chassis 61—which is a media chassis as previously defined.

Each cover 11, 21 has a respective top panel 12, 22 that is formed in a compound-curved surface, but in the right cover 21 the upper rear portion of this curved top 22 is interrupted by an extended well 22' for mounting of a control panel (not shown). Each cover also has a respective outboard surface or side panel 13, 23, also formed in a curved surface that is compound—but less severe.

The outer rear corner of each cover is perforated by respective grillwork 19, 29 for ventilation and—at lower left rear—for emission of sound from an electro-acoustic speaker 34' (FIGS. 27 and 28) that is mounted within an upstanding sheet-metal grill 34 at the left rear of the base 31.

Integrally formed within each side cover 11, 21 is a circumferential plastic stop or rib 18, 28—rising from the floor 18', 28' just where the walls join the floor, as best shown for the left side cover in FIG. 48. This illustration is drawn broken away around all its edges, and also particularly near one end of a shelf-like structure at left center, to show more clearly the nature of the sandwich of thin components along the periphery of the floor 18', 28'.

As shown, the rib or stop 18, 28 cooperates with the floor 18', 28' to form a contoured nest. The upturned shallow rim 32 (see also FIGS. 20 through 26, and 29) and floor of the base 31 fit closely into this contoured nest 18, 28, 18', 28'.

These features define the position of the base 31 within the cover 11, 21 very positively, with respect to three degrees of freedom. Those are: fore-and-aft translation, transverse (left-to-right) translation, and rotation about a vertical axis.

Also integrally formed within the rear corner of each side cover 11, 21, just above the floor 18', 28', is a partially circumferential plastic retaining flange or limiter 10, 20 (best seen in FIG. 48). Each corner limiter 10, 20 cooperates with the floor 18', 28' of the respective cover to define a lateral groove or slot.

The upturned edge 32 of the rear corner of the base 31 fits rather tightly into this slot. The limiter 10, 20 and floor 18', 28' together thus vertically restrain the upturned edge 32 of the base 31 quite tightly.

Also integrally formed in only the left-side cover outboard wall 13 is an additional limiter 10'(FIG. 48). After assembly this limiter 10' is positioned directly above the grillwork mount 34 that holds the electroacoustic speaker 34' (FIG. 27, 28).

The circular speaker 34', when in its mount 34' (and held tightly in place by crimping of its retainers 34", FIG. 48), helps to suppress any residual upward mobility of the base 31 left rear corner. Thus the speaker is effectively integrated into the structural system.

This interfitting of the base edge 32 against the rib 18, 28—and between the floor 18', 28' and the limiters 10, 10', 20—is the hand-in-glove fit mentioned earlier. The restraint contributed by the floor 18', 28' and limiters 10, 10', 20 is positive with respect to two additional degrees of freedom: vertical translation, and rotation about a transverse (left-to-right) horizontal axis.

In addition the limiters 10, 10', 20 and floor 18', 28' together limit motion with respect to rotation about a fore-to-aft horizontal axis. This constraint alone, however, is not positive.

The base 31 as restrained solely by the limiters 10, 10', 20 and floor 18', 28' has some residual freedom to rotate slightly about the fore-to-aft horizontal axis. We therefore refer informally to this particular constraint as taking up a "half degree of freedom".

To provide positive constraint with respect to rotation about that axis, we add a snap fastener 14, 33 (and 24, 33 in the right-side cover). This fastener includes an integrally molded, sharply necked plastic boss 14 (best seen in FIG. 48) upstanding from the floor 18', 28'.

The other part of the snap fastener is a mating aperture 33 (FIG. 29) in the metal base 31. In assembly of the base 31 into floor of the cover 11, 22, the upward tip 14' of the boss 14 is radially compressed to pass into and through the aperture 33, in a tight interference fit.

After entering the aperture 33, however, when the neck 14" of the boss 22 reaches the aperture the resilient tip 14' springs outward, capturing the base 31 closely against the floor 18', 28' of the side cover 11, 12. This firm capture prevents escape of the base 31 from its hand-in-glove fit with the side cover 11, 12.

In particular, because the underside of the boss tip 14' is stepped abruptly, the boss 14, 24 also very greatly reduces freedom of the base 31 to tilt upward out of contact with the floor 18', 28'. Thus the last "half degree of freedom" is closed off.

As can now be appreciated, with the stabilization provided by this connector, the hand-in-glove fit is capable of transmitting forces in all directions. Thus the hand-in-glove fit and snap connector together correspond to the omnidirectional shock transfer means previously introduced.

The three main chassis 41, 51, 61 are secured to the base 31 by mounting bosses, hooks and anchors 36 (FIG. 29) formed in the base 31. The base 31 itself is partially stabilized against flexure by its shallowly upturned rim 32, particularly in the contoured regions near the corners of the base.

Added stability is provided by the taller rim features 35 at front and rear of the base, which also are specially shaped to engage mating paper input and output trays (not structural, and not shown) at rear and front respectively. Also defined in the base 31 are downwardly extending shallow feet 37.

Formed just inside the upper, forwardmost inboard corner of each side cover 11, 21 is a thin vertical panel or web 15, 25 which spans the front and top surfaces and terminates in a generally vertical rearward edge. A notch or slot 15', 25' is defined in that rearward edge to receive a small, flanged retaining boss 45 (FIGS. 37 through 40, and FIGS. 49 through **49*b*) formed in the starwheel chassis 41**.

As best shown in FIG. 49, the retaining boss 45 extends between a side wall 41' of the starwheel chassis proper 41, and an outboard flange 42. The side wall 41' and outboard flange 42 are spaced apart along a narrow flat surface 43.

As best shown in FIG. **49*a*, the cover is to be positioned with the slot or notch 15' very closely enclosing the boss 45, and the web front edges 15 very closely captured between the wall 41' and flange 42. The chassis 41 is in this way stabilized against both forward cover 11, 21** corners, with respect to five degrees of freedom:

- vertical translation, as the top and bottom edges of the notch 15', 25' restrain the body of each boss 45;
- transverse (right-to-left) translation, as the panel 15, 25 is captured between each chassis wall 41' and its associated flange 42;
- rotation about a transverse (right-to-left) horizontal axis near the midregion of the entire device, by virtue of the vertical capture of each boss;
- rotation about a fore-to-aft horizontal axis, by virtue of the vertical capture of the two bosses 45 at the two ends of the starwheel chassis 41 (and thus spaced apart by the width of that chassis); and
- rotation about a generally central vertical axis, analogously by virtue of transverse capture of the two panels 15, 25 spaced apart by the width of the starwheel chassis.

As to the remaining one degree of freedom—namely, fore-to-aft translation—in FIG. **49*a* the front edges 15 of the web are shown coming to rest against the intermediate surface 43. In practice, however, we prefer to dimension and position the parts as shown in FIG. 49*b* so that the boss 45 is nominally out of contact with the frontal edge of the notch 15', 25'**.

More particularly we prefer to provide a clearance generally on the order of 4 to 7 mm (0.2 to 0.3 inch). Such clearance is selected to take up or accommodate inward flexure of the forward cover corners corresponding to fifty-gravities impact.

This configuration is the one-degree-of-freedom slip fit mentioned earlier. It protects the starwheel chassis against frontal impact—in other words, acceleration generally normal to the front surfaces of the covers 11, 12—while transfering tangential loads.

Figures 2, 3, 4, 5, 6, 7, 8, 9, 10:
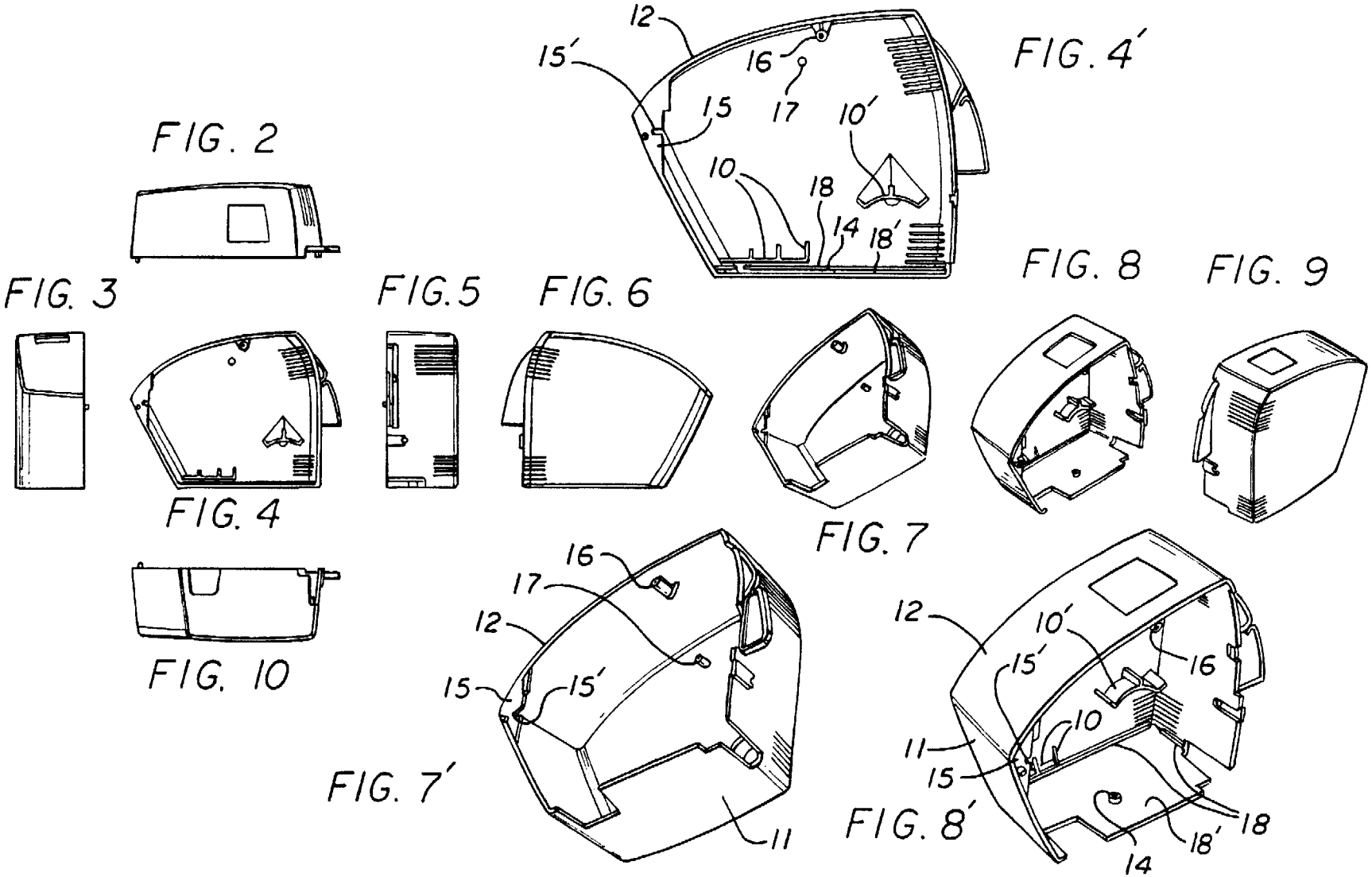
FIGS. 2 through 9 (and 4', 7' and 8') are drawings of the left side cover of the same embodiment as seen from various positions—all to consistent scale, except that the drawings with prime symbols following the numbers are drawn significantly enlarged to better show details—and in particular.
FIG. 10 is a bottom plan.

For verbal-shorthand purposes in this document, including the appended claims, we refer to accelerations and forces "normal" and "tangential" to the cover surfaces and, sometimes, to the front cover in particular. As shown by FIGS. 7', 8', 17' and **49*b*, however, the notches 15', 25'** are not exactly normal to the front cover surfaces, or indeed to any nearby cover surfaces.

Rather, the top and bottom edges of the notches 15', 25' are actually substantially horizontal. Thus they are intended to be most effective in accommodating shock loads such as are developed when the device is dropped with its floor 31, 18', 28' vertical.

Such loading is particularly contemplated in dropping of the device while it is in its shipping container. The container—unlike the device itself—is a rectangular parallelepiped, for greatest convenience of stacking for both inventory and shipping.

Most commonly and satisfactorily the device is placed in the shipping container with the floor of the device parallel to the floor of the container. In such environments a direct frontal shock parallel to the floor 31, 18', 28' of the device is much more likely than acceleration normal to any of the irregularly contoured cover surfaces.

Throughout this document, therefore, when we refer to transfer of shock, force or acceleration "normal" or "tangential" to the cover surfaces, in relation to the one-degree-of-freedom slip fit, we mean to include not only a literal interpretation but also two variants of a literal interpretation. Specifically, we mean to encompass such transfer that is:

(1) only approximately normal or tangential to the cover surfaces, and/or (2) at least approximately parallel or perpendicular, respectively, to the floor of the device.

Formed inside each side cover 11, 21—just below and suspended from its roof 12, 22—is a laterally extending cylindrical boss 16, 26. Each boss 16, 26 has a respective associated mount or bracket 16", which is integrally formed with and depends from the top 12, 22 of the side cover 11, 21. Each boss also has an axial hole 16' (FIG. 50, **50*a*) to receive a fastening screw 66"**.

In assembly each boss 16, 26 is passed into a respective mating cylindrical receptacle 66 (see also FIGS. 30 through 36) provided in the associated side wall 63 of the media chassis 61. More specifically, these receptacles 66 are at the outboard sides of the top forward corners of the media chassis.

After the bosses 16, 26 are positioned in the receptacles 66, they are secured in place by the screws 66'. These screws are passed through fastening holes 66' at the inboard sides of the same corners (and seen, in FIG. 50, at the flat, leftward base of the receptacle 66), and are screwed into the axial holes 16' in the cylindrical bosses 16, 26.

The bosses 16, 26 and receptacle 66 are dimensioned to provide a very close radial/diametral fit. Therefore they control two degrees of translational freedom (fore-and-aft, and vertical).

The mounting screw 66" ensures that the boss 16 bottoms out firmly into the base of the receptacle 66, thus controlling the third degree of translational freedom (transverse). Relative rigidity of each media-chassis side wall 63 (FIG. 31, and FIGS. 33 through 36), cooperating with firm attachment between each bottom corner of that chassis and the base 31, preclude rotation about a transverse axis; and the two walls 63 cooperate to control rotation or torsion about a vertical axis.

Furthermore on a very small, local scale the abutting flat faces of the boss 16 and the base of the receptacle 66 cannot undergo mutual rotation about a fore-to-aft axis. On a very local attachment basis, therefore, this attachment system can be said to control all six degrees of freedom; however, this is not entirely true on an overall structural basis—as will be seen shortly.

These attachments are the "male-female feature" mentioned earlier. As can now be appreciated, they provide a very thorough omnidirectional coupling between the covers and the media chassis 61 (at its top end).

As previously indicated, that chassis 61 (at its bottom end) is also firmly secured to the base 31, and the connections described to this point stabilize the chassis 61 to the covers against virtually all types of shock loads. One motion to which this subsystem does remain vulnerable, however, is transverse swaying of the generally parallelogram-shaped media chassis.

This motion may also be described as rotation of the media-chassis side walls 63 about their bottom attachments to the base 31. Each wall rotates about a respective fore-to-aft axis at its base, and the two axes are parallel. The upper part of the media chassis is not sufficiently extended vertically to be effective in preventing this sway.

This particular motion can be induced in the media chassis 61 by transverse shock transmitted from an upper surface 12, 22 of either cover 11, 21. Such shock coupling can arise through transverse (right/left) impacts to upper portions of the outboard surfaces 13, 23 of the covers.

This mode of shock coupling tends to rip the central subassembly 62 of the media chassis away from its side walls 63. It thus can be quite damaging to the media chassis 61. Our invention manages this type of shock loading as follows.

Formed at the inside surface of each cover 11, 21 is a respective cylindrical boss 17, 27 (FIG. 7', 17', and 51 through **51*b*)—extending transversely inward from the associated outboard side wall 13, 23. This boss 17, 27 is aligned to transversely engage a rigid angle-type crossbeam 57-59 (FIG. 1*b*, FIGS. 42 through 47, and FIGS. 51 through 51*b*) of the printer chassis 51**.

More specifically the sheet-metal printer chassis 51 has a long fold corner 57 (FIG. 46), formed in bending over of the long horizontal tab 58 (FIG. **1*b*, and FIGS. 42 through 47) from the generally vertical wall 59. The centerline ℄ of the boss 17, 27 is centered along that long, stiff fold corner 57**.

Accordingly the boss 17, 27 presses against both the horizontal tab 58 and the vertical wall 59, in event of transverse impact inward against an upper portion of the associated side wall or outboard surface 13, 23. To avoid conspicuous bulging caused by outward pressure on the side wall when the structure is quiescent, we prefer to leave a nominal clearance of three-quarters millimeter (0.03 inch) along the transverse (left-to-right) direction between the end of each boss 17, 27 and its associated adjacent end of the angle beam 57-59.

Therefore inward forces received in this region are received by the printer chassis 51 rather than the media chassis 61. As FIG. 44 shows, the printer chassis 51 has relatively wide side columns 52 of formed sheet metal.

Each of these columns 52 imparts to the printer chassis 51 far greater rigidity with respect to transverse torsional sway than the parallelogram-shaped media chassis 61 has. Accordingly, transverse shock loading from either upper side cover outboard surface 13, 23 is resisted by the adjacent printer-chassis column 52 and transmitted down through it to the near midregion of the base 31.

Part of such loading is also transmitted through the adjacent column 52 and the long transverse angle-type crossbeam 57-59 to the remote printer-chassis column 52. That remote column provides further resistance to lateral rotation, and further coupling to the remote midregion of the base 31.

The crossbeam 57-59 also couples such force from either outboard surface 13, 23 to the opposite outboard surface 23, 13 respectively—which in turn provides still further coupling through the hand-in-glove fit and snap connector to the remote end of the base 31.

In this way transverse forces are accepted in the printer chassis 51 and distributed through its side columns and through both covers 11, 21 into different regions of the base 31. The combination of the bosses 17, 27 inside the covers 11, 21 with the long corner 57-59 of the printer chassis 51 thus protects the media chassis very effectively against the swaying action to which it is vulnerable. This combination 17, 27, 57-59 makes up the flexure stop discussed earlier.

As shown earlier, all other modes of shock loading are well managed by the male-female coupling in cooperation with the media chassis 61. Therefore overall resistance to impacts is excellent for the structure considered as a unit.

As mentioned previously we have verified complete operational survival of accelerations up to fifty times that of gravity, in dropping the device inside its shock-absorbing shipping container.

The above disclosure is intended as merely exemplary, and not to limit the scope of the invention—which is to be determined by reference to the appended claims.

What is claimed is:

1. An enclosure-and-structural system, for a desktop image-related device that is subject to mechanical shock loads during shipping and the like; said system comprising:

plural side covers;

a major chassis element of the image-related device; and means for attaching the covers to the chassis element, said attaching means comprising means for omnidirectional transfer of such shock loads between the covers and the chassis element;

said transfer means comprising a hand-in-glove fit of a portion of the chassis element into each of the covers.

2. The system of claim 1, wherein the transfer means further comprise, for each cover:

integrally formed in that cover and in the chassis element respectively, complementary retaining means for mutually engaging to hold that cover and the base together in said hand-in-glove fit.

3. The system of claim 2, wherein:

the major chassis element is a formed sheet-metal base;

the base has plural edges; and the hand-in-glove fit of the transfer means comprises a slot for receiving a respective edge of the base.

4. The system of claim 3, for use with an image-related device that includes a component that has a nonstructural function, and wherein the transfer means further comprise:

means for securing the component to one of the covers; and means for securing the component to the base too, for transmission of shock loads between the base and said one of the covers through the component.

5. The system of claim 3, wherein:

each of the covers is integrally molded as a complex shape in thin plastic with large surfaces forming compound curves.

6. The system of claim 1, for use with an image-related device that includes an assembly which is disposed, within the image-related device, closely adjacent to an interior face of at least one particular cover; said system further comprising:

another major chassis element for supporting such an assembly; and means for attaching the covers to the assembly chassis, said attaching means comprising additional means for selective coupling of such shock loads between at least one particular cover and said other chassis element;

said selective coupling means comprising, for each cover, means for:

transfering, between said other chassis element and that cover, shock loads that are generally tangential to the local surface of that cover, but taking up, with minimal shock-load transfer between said other chassis element and that particular cover, shock loads that are generally normal to the local surface of that cover.

7. The system of claim 6, wherein:

for each cover, the additional transfer means comprise a one-degree-of-freedom slip fit.

8. The system of claim 1, further comprising:

a second chassis element having relatively little rigidity with respect to tilting in a particular direction;

means for attaching the covers to the second chassis element, whereby the second chassis element is subject to tilting in event of flexure of the covers in that particular direction; and means for protecting the second chassis element by limiting flexure in that cover.

9. An enclosure-and-structural system for a desktop image-related device that is subject to shock loads during shipping and the like; said system comprising:

plural side covers;

a main structural assembly; and means, integrally formed in the covers and the main structural assembly, for attaching the covers to the main structural assembly;

said attaching means comprising coupling means which take up at least four degrees of freedom of motion between the covers and the main structural assembly.

10. The system of claim 9, further comprising:

further coupling means which take up substantially all remaining motional freedom between the covers and the main structural assembly.

11. The system of claim 10, wherein:

the main structural assembly comprises a formed sheet-metal base and a chassis rigidly mounted to the sheet-metal base;

the first-mentioned coupling means hold the sheet-metal base to the covers, and include no separate fastener; for holding the base to the covers; and the further coupling means hold the chassis to the covers.

12. The system of claim 11, wherein:

each cover is integrally molded as a complex shape in thin plastic with large surfaces forming compound curves.

13. The system of claim 10, further comprising:

an additional chassis element that is disposed within the image-related device, closely adjacent to an interior face of at least one cover, and is subject to damage by impacts;

said attaching means comprising means for selective coupling of shock loads between the additional chassis element and said at least one cover;

said selective coupling means comprising, for each cover to which the additional chassis is closely adjacent, means for:

transfering, between the additional chassis element and that cover, shock loads that are generally tangential to the local surface of that cover, but taking up, with minimal shock-load transfer between the chassis and that cover, shock loads that are generally normal to the local surface of that cover.

14. An enclosure-and-structural system for a desktop image-related device that is subject to shock loads during shipping and the like; said system comprising:

plural side covers;

a first major chassis element;

first means for attaching the covers to the first chassis element, said first attaching means comprising means for omnidirectional transfer of such shock loads between the covers and the first chassis element;

a second major chassis element, disposed within the image-related device and closely adjacent to an interior surface of at least one cover; and second means for attaching the at least one cover to the second chassis element, said second attaching means comprising means for directionally selective coupling of such shock loads between the second chassis element and the at least one cover.

15. The system of claim 14, wherein said selective coupling means comprise, for each cover, means for:

transfering, between the additional chassis element and that cover, shock loads that are generally tangential to the local surface of that cover, but taking up, with minimal shock-load transfer between the chassis and that cover, shock loads that are generally normal to the local surface of that cover.

16. The system of claim 15, wherein:

the selective coupling means comprise a one-degree-of-freedom slip fit.

17. The system of claim 16, wherein:

the second chassis element supports a starwheel assembly which is disposed within the image-related device and adjacent to and just within the covers, to accept and engage image media and propel the image media into the image-related device.

18. The system of claim 15, wherein:

the first chassis element has plural edges; and the omnidirectional transfer means comprise plural slots, at least one in each cover, corresponding to the plural edges of the first chassis element respectively, for respectively receiving said corresponding edges of the first chassis element in a hand-in-glove fit.

19. The system of claim 18, wherein the omnidirectional transfer means further comprise, for each cover:

means integrally defined in that cover and in the first chassis element respectively, for mutually engaging to hold the cover and first chassis element together.

20. The system of claim 15. The system of claim 1, further comprising:

a second chassis element having relatively little rigidity with respect to tilting in a particular direction;

means for attaching the covers to the second chassis element, whereby the second chassis element is subject to tilting in event of flexure of the covers in that particular direction; and means for protecting the second chassis element by limiting flexure in that cover.

* * * * *